US005101806A

United States Patent [19]

Hunt et al.

[11] Patent Number: 5,101,806

[45] Date of Patent: Apr. 7, 1992

[54] GAS INFRA-RED BURNER IN A HEATER TUBE OR HEAT EXCHANGER

[75] Inventors: Gerald W. Hunt; David W. Mayell, both of Christchurch, New Zealand

[73] Assignee: Moffat Appliances Limited, Christchurch, New Zealand

[21] Appl. No.: 567,702

[22] Filed: Aug. 15, 1990

Related U.S. Application Data

[63] Continuation-in-part of Ser. No. 284,026, Dec. 14, 1988, abandoned.

[30] Foreign Application Priority Data

Dec. 15, 1987 [NZ] New Zealand ..... 222930

[51] Int. Cl.[5] ..... A47J 27/02; F23D 14/14

[52] U.S. Cl. ..... 126/391; 126/343.5 R; 126/92 AC; 431/329; 99/403

[58] Field of Search ..... 431/329, 326, 328; 126/92 R, 92 AC, 92 B, 92 C, 83, 343.5 R, 343.5 A, 391; 99/403

[56] References Cited

U.S. PATENT DOCUMENTS

| | | | |
|---|---|---|---|
| 877,871 | 1/1908 | Snitjer | 126/83 |
| 1,630,309 | 5/1927 | Pitman | 126/391 |
| 2,182,735 | 12/1939 | O'Dowd | 126/391 |
| 2,429,360 | 10/1947 | Kells | 126/391 |
| 3,169,572 | 2/1965 | Constance et al. | 431/329 |
| 3,200,874 | 8/1965 | Koppel | 431/329 |
| 3,313,288 | 4/1967 | Aho | 126/391 |
| 3,326,265 | 6/1967 | Paulin | 431/329 |
| 3,762,857 | 10/1973 | Andeweg | 431/289 X |
| 3,970,072 | 7/1976 | Chipcase | 126/391 |
| 4,053,279 | 10/1977 | Eichenlaub | 126/92 C X |
| 4,234,303 | 11/1980 | Neugart | 431/293 |
| 4,477,249 | 10/1984 | Puzek et al. | 431/289 X |
| 4,568,269 | 2/1986 | Lin | 431/289 X |
| 4,651,714 | 3/1987 | Granberg | 126/391 X |
| 4,657,506 | 4/1987 | Ihlenfield et al. | 431/329 |
| 4,690,127 | 9/1987 | Sank | 126/391 |
| 4,797,088 | 1/1989 | Nakamura et al. | 431/79 X |
| 4,804,323 | 2/1989 | Kim | 431/253 |

FOREIGN PATENT DOCUMENTS

| | | | |
|---|---|---|---|
| 662568 | 4/1965 | Belgium | 431/329 |
| 0146247 | 6/1985 | European Pat. Off. . | |
| 1049806 | 2/1959 | Fed. Rep. of Germany . | |
| 3618309 | 12/1986 | Fed. Rep. of Germany . | |
| WO8404375 | 11/1984 | PCT Int'l Appl. . | |
| 2175994 | 12/1986 | United Kingdom | 431/291 |

*Primary Examiner*—Carl D. Price

*Attorney, Agent, or Firm*—Finnegan, Henderson, Farabow, Garrett and Dunner

[57] ABSTRACT

An improved gas burner for a cooking tank or heating air via a heat exchanger, the burner including a distribution tube which is closed at one end and mounted within a burner shell. The upper generally semi-cylindrical surface layer of the burner shell is formed as a mesh structure from at least three layers of mesh, the upper layer of which is laid with the axis of its grid at an angle of 45° to the longitudinal axis of the burner. The distribution tube and shell are mounted in a heat exchanger of a cooking tank or convection oven, the arrangement being such that a combustible gas fed via an injector to an end of the distribution tube is spread evenly along the length of the tube to be burnt as it diffuses through the mesh structure. The mesh glows to produce infra-red radiation which is transferred to the full length of the heat exchanger to thereby increase heat transfer to the contents of the cooking tank or to air in contact with the heat exchanger. Additionally, the heat exchanger can include a tubular housing for the gas burner, the housing having at its output end a weir plate positioned to retain, in an upper region of the tubular housing, heat and combustion gases from the gas burner to thereby improve heat transfer through the tubular housing to the cooking tank or to the surrounding air.

15 Claims, 3 Drawing Sheets

GAS INFRA-RED BURNER IN A HEATER TUBE OR HEAT EXCHANGER

CROSS-REFERENCE TO RELATED APPLICATION

This application is a continuation-in-part of application Ser. No. 07/284,026, now abandoned filed Dec. 14, 1988.

FIELD OF THE INVENTION

The invention relates to cooking equipment and more particularly to an improved infra-red burner for a heat exchanger configured for use in fish fryers and boiling tanks in which foods are boiled, heated or fried, and in radiant heaters for convection gas ovens.

BACKGROUND OF THE INVENTION

At present in commercial cooking equipment foods are boiled, fried or heated in containers which are shaped to include a bath or tank in which the foodstuffs are placed while cooking.

The baths are heated in a number of ways, for example with an electric element or elements and by burning gas which heats the lower region of the bath in which the cooking liquid is retained.

A problem with existing fish fryers is that if the surface area heating the oil or fat is directly heated, for example, by a blue flame burner heating a steel panel on the other side of which is contained the oil, etc., that surface area can overheat. Any overheating can cause fatty acids to develop quickly with a result that oil life is substantially reduced. Moreover, the life of the steel panel, or heat exchanger, is also substantially reduced.

SUMMARY OF THE INVENTION

An object of the invention is to provide an improved gas burner and heat exchanger for use with cooking tanks or fryers, or heating air.

A further object of the invention is to provide an improved gas burner and heat exchanger which can be a useful alternative choice for any of various heating purposes, which solves the problems of uneven reflective heatings between a burner mesh structure and a tubular heat exchanger in burners used in an environment relatively deprived of secondary air.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

To achieve the objects and in accordance with the purpose of the invention, as embodied and broadly described herein, the improved gas burner of this invention comprises a distribution tube which is closed at one end and a burner shell within which the tube is disposed the shell having an upper generally semi-cylindrical portion including at least three layers of mesh, the upper layer of which has an axis of its grid at an angle of approximately 45° to the longitudinal axis of the burner shell, the distribution tube and burner shell being mounted in a heat exchanger of a cooking tank, the arrangement being such that a combustible gas fed through the distribution tube is spread evenly along the length of the burner shell to be burnt as it diffuses through the layers of mesh which glow to produce infra-red radiation which is transferred to the heat exchanger.

Without wishing to be bound to any theory, applicants submit that the approximate 45° mesh orientation provides unusually even heating and long life of the assembly, especially of a tubular heat exchanger, in environments relatively deprived of secondary air. This orientation means that no filamentary member of the upper layer of mesh is parallel to, or even substantially parallel to, any linear element of the associated heat exchanger, thereby avoiding uneven reflective heating.

The top woven-cloth-type mesh may be of a metal alloy material which differs from the material of the lower mesh(es), at least one of which can have its/their axis parallel to the longitudinal axis of the burner, which also is parallel to the axis of the illustratively tubular heat exchanger.

The burner can be square, circular, elliptical, oval, triangular or obround in cross section.

According to a second aspect of the invention there is provided an improved gas burner for heating air in a gas convection oven, the burner including a distribution tube which is closed at one end and a burner shell within which the tube is disposed, the shell having an upper generally semi-cylindrical portion which is formed from at least three layers of mesh, the upper layer having the axis of its grid at an angle of approximately 45° to the longitudinal axis of the burner shell, and in the gas convection oven, an elongated heat exchanger radiatively and convectively coupled to the burner, the arrangement being such that a combustible gas fed through the distribution tube is spread evenly along the length of the tube to be burnt as it filters through the layer of mesh which glow to produce infra-red radiation which is transferred to the heat exchanger.

The elongated heat exchanger may comprise a tubular housing which can in section be square, round, elliptical, oval or obround and the gas burner mounted therein can be a burner according to a first aspect of the invention.

The heating assembly (cooking tank or oven) in which the burner and heat exchanger are fitted can include one or more similar burner/tubular housing units according to either of the first and second aspects of the invention.

BRIEF DESCRIPTION OF THE DRAWINGS

The accompanying drawings, which are incorporated in and constitute a part of the specification, illustrate the presently preferred apparatus of the invention and, together with the general description given above and the detailed description of the preferred embodiment given below, serve to explain the principles of the invention. Of the drawings.

DESCRIPTION OF THE PREFERRED EMBODIMENTS

The embodiments shown in FIGS. 1 to 4 are fryer tanks; and it is envisaged that in keeping with the teachings of the invention the shape and configuration can be changed to suit different heating assemblies, whether they are designed for frying or cooking in oil, fat or water or for heating foodstuffs or air using air convection.

Figure 2:
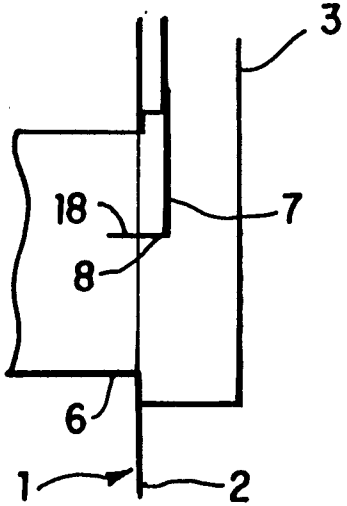
FIG. 2 shows an example of a weir plate mounted relative to one of the heat exchanger tubes shown in FIG. 1.
Figure 1:
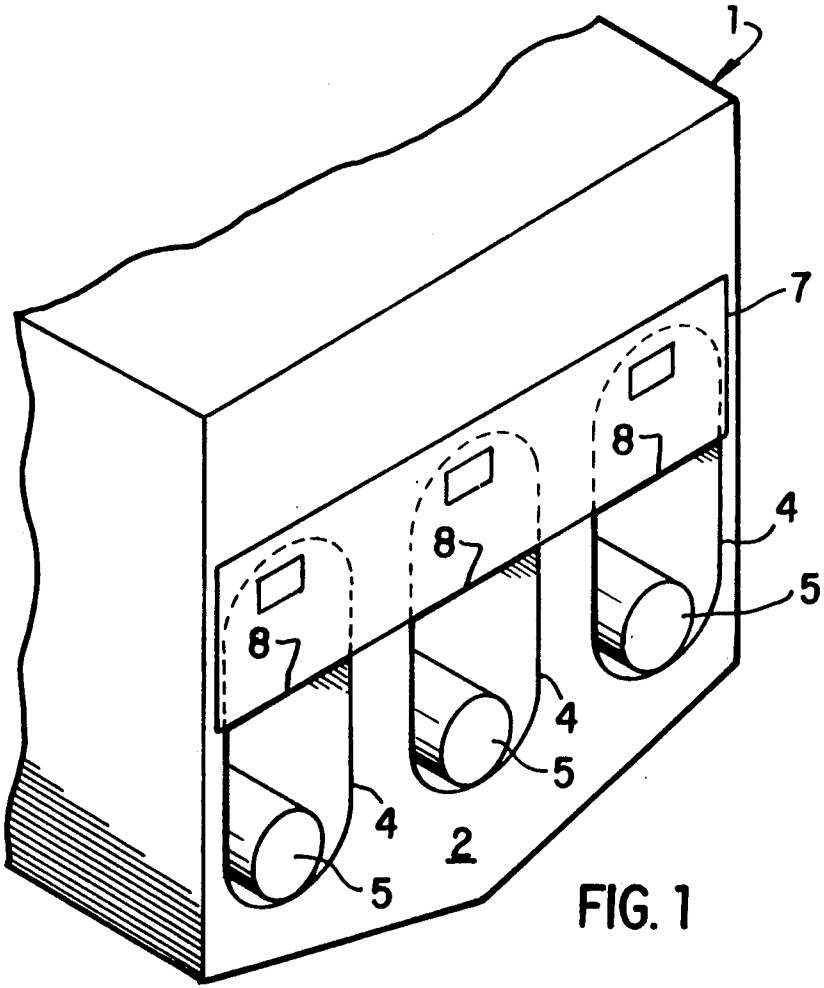
FIG. 1 shows a perspective view of the rear of a fryer tank incorporating a heat exchanger according to the invention.

FIGS. 1 and 2 shows part of a fryer tank 1 and this consists of a stainless steel housing one end 2 of which has a flue outlet 3 (FIG. 2) connected thereto. The tank 1 has three similar exchanger tubes 4 each of which has a burner 5, an example of which is shown in more detail in FIG. 5. The outlet end 6 of each tube 4 has a weir plate 7. The weir plate 7 of each tube 4 can be discrete, or as shown in FIG. 1 an elongate plate 7 can be utilized. Preferably, each tube 4 has its own weir plate 7. The weir plates 7 can be mounted as shown in FIG. 2 spaced from the end 6 of each tube 4; and, preferably, the edge 8 of plate or plates 7 extends to a point near to the center of the tubes 4.

Alternatively, the weir plate can have a return 18 on its lower edge, which extends into a heat exchanger tube to thereby trap further heat. (See FIG. 2).

Alternatively, the weir plate(s) 7, can be inset into the end of each heat exchanger tube 4. In order to improve heat exchange efficiency, the inner surface of each tube 4 can be coated with a surface coating which may be manganese dioxide or other stable compound which will form a matt black coating.

Figure 5:
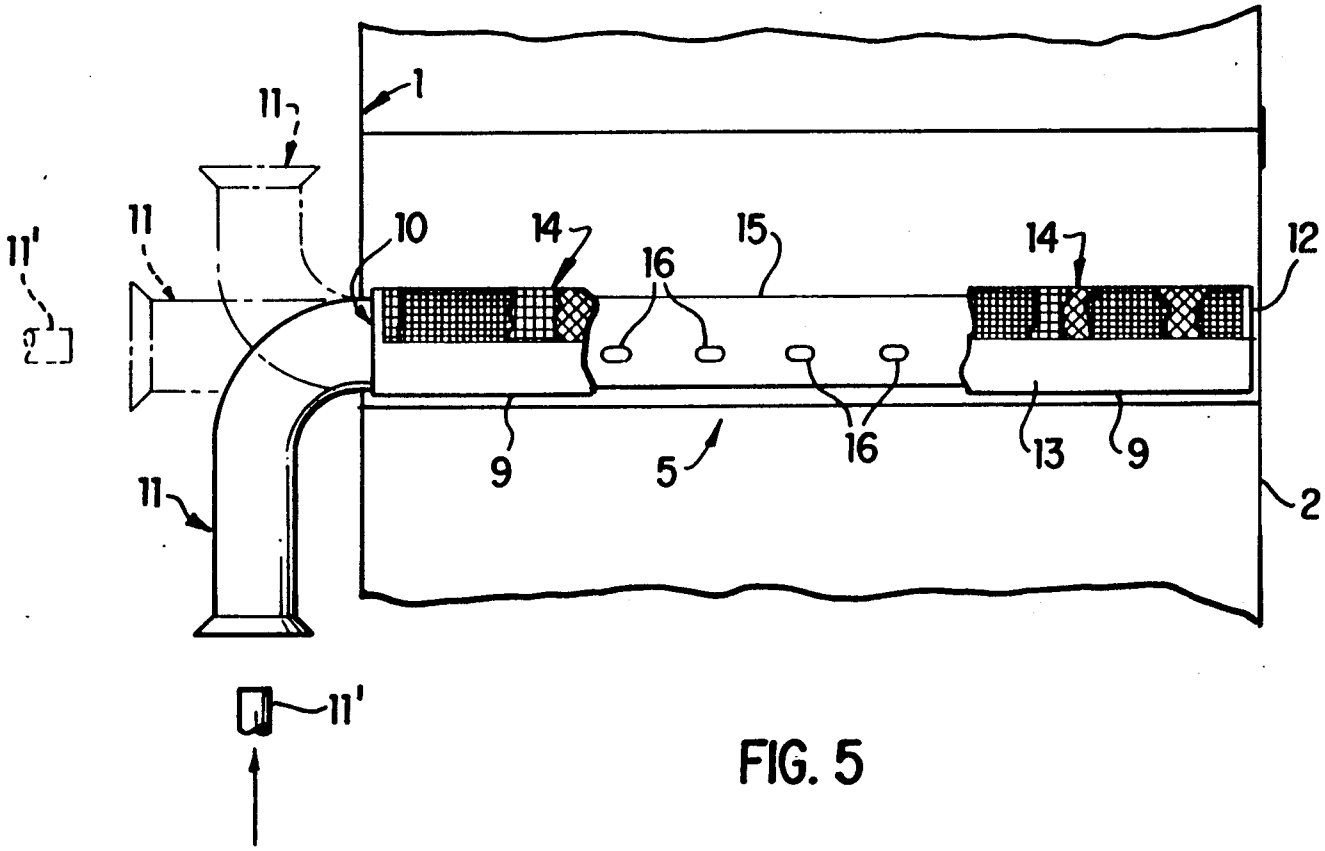
FIG. 5 shows a side view partly sectioned of an example of gas burner suitable for placement in the heat exchanger tubes of the fryer tanks shown in FIGS. 1 to 4 or for use in heating air.

The heat exchanger tubes 4 each have their own burner 5, an example of which is shown in FIG. 5. Each burner 5 has a burner shell 9 an input end 10 of which has a mixer tube 11 which can extend straight along the axis of the burner tube or at any angle through 360° to suit gas flow from an injector 11'. An opposite end 12 of the burner shell 9 is closed, as is also the distribution tube 15 therein. The burner shell 9 can consist of a semi-cylindrical member 13 the upper portion 14 of which is formed of a plurality of mesh layers. In the preferred embodiment, the portion 14 is formed from a series of differently-sized, differently-oriented meshes to form a composite structure through which gas diffuses and is burnt efficiently to produce infrared radiation. Preferably, there are at least three mesh layers in the composite structure.

The purpose of this composite structure, as well as the purpose of the overall combinations of this invention, is to economize in the use of gas. Specifically, the preferred embodiment of the burner, as illustrated in FIG. 5, consumes only 55% as much gas as a typical blue flame type gas burner intended for heat exchanger uses. The composite structure of the upper portion 14 of the burner shell 9 includes an upper mesh layer having an axis of its grid at an angle of 45° with respect to the longitudinal axis of the burner, which is the axis of the burner shell 9 (which can be the axis of its semi-cylindrical member 13 or the axis of its distribution tube 15). At least one of the two mesh layers below the upper layer has a mesh opening size different from that of the upper layer and has an axis of its respective grid substantially aligned with the burner axis. A grid axis is a selected one of the two directions parallel to filamentary members of a mesh.

The overall effect of the composite structure is a steady diffusion effect in which the gas to be burnt diffuses through the meshes, which in combination glow steadily during burning of the gas on the upper mesh to produce the infrared radiation which is absorbed by radiatively-coupled portions of the heat exchanger housing (the respective tube 4). The absorption of the available heat energy is more evenly dispersed over a wide surface area of the housing, as compared to absorption from a blue flame gas burner in a comparable use. No heating surface area of the heat exchanger reaches as high a temperature as would the hottest portion in response to a blue flame; and, in a fryer, the life of the oil or fatty acids is extended up to three-fold. The life of the fryer heat exchange surfaces is extended up to 10 times that for a blue fame burner in comparable use.

The burner shown in FIG. 5 can also be used for heating air provided it is mounted in a suitable housing.

In use the gas is fed to the annular space between a distribution tube 15 and the shell 9 via a series of suitably positioned holes 16. The placement and size of the holes 16 is selected to spread evenly the gas fire along the length of the shell 9, thereby further increasing the even heating effect according to the invention.

Figure 3:
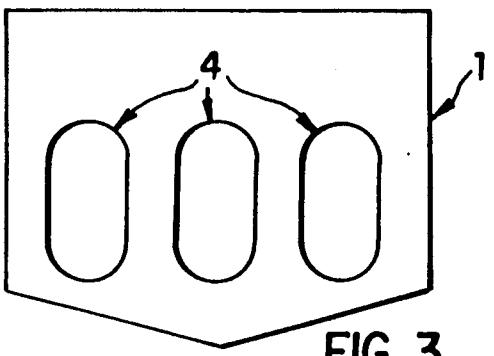
FIG. 3 shows an end view of one example of fryer tank.
Figure 6E:
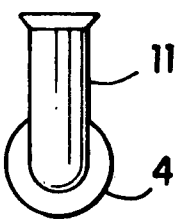
FIGS. 6a–6e shows three alternative shapes of burner with different orientations of associated mixing tubes indicating different entry angles.
Figure 6D:
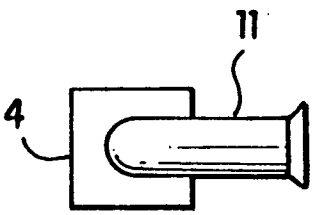
Figure 6C:
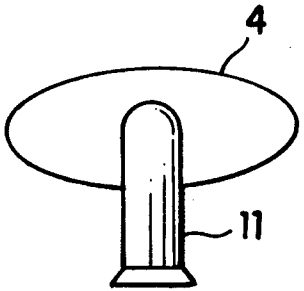
Figure 4:
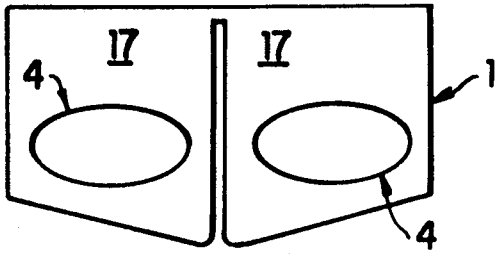
FIG. 4 shows an end view of a second example of fryer tank.
Figure 6A:
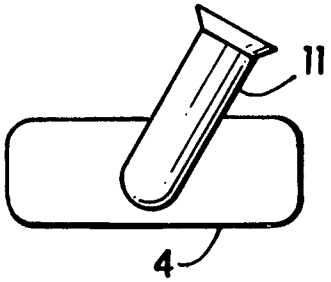
Figure 6B:
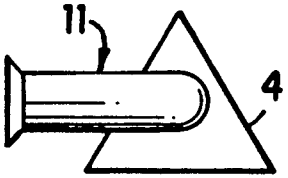

The heat exchange tubes 4 can have a variety of shapes as can the burner shell 9 to suit a user's requirements. For example, as shown in FIG. 1 the tubes 4 can be obround in section. The term obround is used to mean a tube in section which has generally parallel sides but with rounded ends. Alternative shapes of tube 4 are shown in FIG. 3, 4 and 6. In FIG. 3 is shown a tank 1 heatable by three similar obround sectioned tubes 4. In FIG. 4 is a two tank unit in which each fryer tank 17 is heated by a single elliptical heat exchange tube 4. FIG. 6 shows five other examples of burner heat exchanger tubes with differently angled and directed mixer tubes 11, any of the mixer tubes being usable with any of the burner tubes. For example, the two tubes 4 to the upper left are rectangular and oval in cross-section.

In the use of the preferred embodiment with at least a burner 5 operating, the gas flows from injector 11' to be fed along with the air in mixer tube 11 and distributed from the elongate holes or ports 16 in distribution tube 15 to flow evenly through the mesh upper portion 14 of burner shell 9 where it burns incandescently thereby creating infra-red radiation along the full length of the shell 9. The infrared radiation is absorbed by the radiatively coupled portions of the heat exchanger tube 4; and the convectively component of the available heat energy rises to be trapped against the surface of the tube 4 by the weir plate 7. The provision of the weir plate 7 slows the rate of flow to the flue outlet 3 thereby improving heat transfer to a cooking medium surrounding the tube 4.

The application for this infra-red burner is for the heating of air, water, oil and fats used in frying. The purpose of the burner is to economize in the use of gas, and it achieves this by consuming only 55% of the amount of gas compared with comparable blue flame type burners. Also, the infra-red radiation can be dispersed over a wide surface area, so that in a fryer the surface area heating the oil does not reach the extremely high temperatures achieved with a blue flame burner impinging on a steel panel. Consequently, fatty acids are not developed quickly and the oil life is extended by three times the life achieved in a fryer with blue flame burners. Also, because of this, the life of the steel tank itself is extended by more than 10 times.

Present use for this burner are in the exchanger type tubes in fish fryers and boiling tanks, and in radiant heaters that heat the surface and the air of convection gas ovens.

Thus, by this invention there is provided an improved gas burner and heat exchanger for cooking or heating air.

Additional advantages and modifications will readily occur to those skilled in the art. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What we do claim and desire to obtain by Letters Patent of the United States is:

1. An improved heater assembly for heating a cooking tank via a heat exchanger, comprising a burner including a distribution tube which is closed at one end and a burner shell within which the tube is disposed, the shell having a generally cylindrical upper portion including at least three layers of mesh, the upper layer of which comprises a grid that has an axis of the grid at an angle of approximately 45° to the longitudinal axis of the burner shell, the burner shell and distribution tube being mounted in the heat exchanger of the cooking tank, the heat exchanger being tubular and having a longitudinal axis that is parallel to the longitudinal axis of the burner shell, the arrangement being such that a combustible gas fed through the distribution tube is spread evenly along the burner shell to be burnt as it diffuses through the layers of mesh which glow to produce infra-red radiation which is transferred to the heat exchanger.

2. A burner as claimed in claim 1 wherein the burner shell is square, circular, elliptical, oval, triangular or obround in cross section.

3. A burner as claimed in claim 2 wherein the distribution tube has an input end and connected thereto, a mixer tube.

4. A burner as claimed in claim 3 wherein the burner shell is a cylindrical member the upper generally semi-cylindrical portion of which includes the layers of mesh, at least one of the lower layers of which has an axis of its grid substantially aligned with the axis of the burner shell.

5. A burner as claimed in claim 4 wherein the layers of mesh have different-sized mesh openings through which the gas diffuses and is burnt.

6. A burner as claimed in claim 5 where the distribution tube has a series of holes positioned at intervals along the length thereof.

7. A burner as claimed in claim 1, in which the heat exchanger includes at its output end a weir plate positioned to retain convective gases from the gas burner to improve heat transfer from the burner shell and the gas burnt thereon to the tubular heat exchanger.

8. A burner as claimed in claim 7 wherein the weir plate has a return which extends into the tubular heat exchanger.

9. A burner according to claim 8 including a plurality of burner shells, a plurality of respective distribution tubes each in one of said shells, and a plurality of respective tubular housings, as the heat exchanges the cooking tank being heatable by the tubular housings.

10. A burner as claimed in claim 7 wherein the tubular heat exchanger is, in section, square, round, elliptical, triangular, oval or obround.

11. An improved heater assembly for heating air in a gas convection oven, comprising a burner including a distribution tube which is closed at one end and a burner shell within which the tube is disposed, the shell having an upper generally semi-cylindrical portion including at least three layers of mesh, the upper layer comprising a grid having an axis of the grid at an angle of approximately 45° to the longitudinal axis of the burner shell, and an elongated tubular heat exchanger radiatively and convectively coupled to the burner, the heat exchanger surrounding the burner and having a longitudinal axis parallel to the longitudinal axis of the burner shell, the arrangement being such that a combustible gas fed through the distribution tube is spread evenly along the burner shell to be burnt as it diffuses through the layers of mesh which glow to produce infra-red radiation which is transferred to the heat exchanger.

12. A burner as claimed in claim 11 wherein the burner shell is a cylindrical member the upper generally semi-cylindrical portion of which includes the layers of mesh, at least one of the lower layers of which has an axis of its grid substantially aligned with the axis of the burner shell.

13. A burner as claimed in claim 12 wherein heat exchanger comprises a tubular housing around the burner shell, the housing being square, circular, elliptical, oval, triangular or obround in cross section.

14. An improved heater assembly for heating a cooking tank via a heat exchanger, comprising a burner including a distribution tube which is closed at one end and has an input end and connected thereto a mixer tube, and including a cylindrical burner shell within which the tube is disposed, the shell having a generally cylindrical upper portion including at least three layers of mesh, the upper layer of which comprises a grid that has an axis of the grid at an angle of approximately 45° to the longitudinal axis of the burner shell, whereas at least one of the lower layers has a grid that has an axis substantially aligned with the axis of the burner shell, the burner shell and distribution tube being mounted in the heat exchanger of the cooking tank, the heat exchanger being tubular and having a longitudinal axis that is parallel to the longitudinal axis of the burner shell, the arrangement being such that a combustible gas fed through the distribution tube is spread evenly along the burner shell to be burnt as it diffuses through the layers of mesh which glow to produce infra-red radiation which is transferred to the heat exchanger, said tubular heat exchanger having a curved surface facing the upper portion of the burner shell, the 45° angle of the axis of the grid of the upper layer of the burner shell tending to provide even reflective heating of said curved surface of said tubular heat exchanger.

15. An improved heater assembly for heating air in a gas convection oven, comprising a burner including a distribution tube which is closed at one ned and has an input end and connected thereto a mixer tube, and including a cylindrical burner shell within which the tube is disposed, the shell having an upper generally semi-cylindrical upper portion including at least three layers of mesh, the upper layer comprising a grid having an axis of the grid at an angle approximately 45° to the longitudinal axis of the burner shell, whereas at least one of the lower layers has a grid that has an axis substantially aligned with the axis of the burner shell, and an elongated tubular heat exchanger radiatively and convectively coupled to the burner, the heat exchanger surrounding the burner and having a longitudinal axis parallel to the longitudinal axis of the burner shell, the arrangement being such that a combustible gas fed through the distribution tube is spread evenly along the burner shell to be burnt as it diffuses through the layers of mesh which glow to produce infra-red radiation which is transferred to the heat exchanger, said tubular heat exchanger having a curved surface facing the upper portion of the burner shell, the 45° angle of the axis of the grid of the upper layer of the burner shell tending to provide even reflective heating of said curved surface of said tubular heat exchanger.

* * * * *